US010230201B2

(12) United States Patent
Lanzotti

(10) Patent No.: US 10,230,201 B2
(45) Date of Patent: Mar. 12, 2019

(54) CONNECTOR ASSEMBLY HAVING A CONNECTOR HOUSING INCLUDING CAM RIBS

(71) Applicant: Sumitomo Wiring Systems, Ltd., Yokkaichi, Mie (JP)

(72) Inventor: Joseph Lanzotti, Grosse Pointe, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 156 days.

(21) Appl. No.: 15/248,789

(22) Filed: Aug. 26, 2016

(65) Prior Publication Data

US 2017/0063001 A1 Mar. 2, 2017

Related U.S. Application Data

(60) Provisional application No. 62/212,839, filed on Sep. 1, 2015.

(51) Int. Cl.
*H01R 13/74* (2006.01)

(52) U.S. Cl.
CPC ..... *H01R 13/743* (2013.01)

(58) Field of Classification Search
CPC ..... H01R 13/743; H01R 13/73; H01R 13/74
See application file for complete search history.

(56) References Cited

U.S. PATENT DOCUMENTS

| | | | | |
|---|---|---|---|---|
| 5,709,560 | A | 1/1998 | Hio | |
| 2002/0081877 | A1 | 6/2002 | Ohnuki | |
| 2006/0205264 | A1 | 9/2006 | Katsuma | |
| 2008/0153356 | A1 | 6/2008 | Chazottes | |
| 2010/0130059 | A1* | 5/2010 | Lee | H01R 13/743 439/567 |
| 2015/0044900 | A1* | 2/2015 | Mcdowall | H01R 13/6275 439/372 |

FOREIGN PATENT DOCUMENTS

JP 2014-241253 A 12/2014

* cited by examiner

*Primary Examiner* — Briggitte R Hammond
(74) *Attorney, Agent, or Firm* — Honigman LLP

(57) ABSTRACT

A connector assembly includes at least one connector having terminals. A connector housing having a cavity formed therein receives the at least one connector. The connector housing includes a body having opposing top and bottom walls joined with opposing side walls. The cavity extends through the front and rear walls. The top wall includes a plurality of cam ribs formed thereon that define a travel path of the connector housing when installed.

19 Claims, 5 Drawing Sheets

CONNECTOR ASSEMBLY HAVING A CONNECTOR HOUSING INCLUDING CAM RIBS

CROSS-REFERENCE TO RELATED APPLICATIONS

This application claims priority of U.S. Provisional Application No. 62/212,839 filed Sep. 1, 2015, the contents of which are incorporated herein by reference.

FIELD OF THE INVENTION

The invention relates to connector assemblies and with more particularity to connector assemblies having a housing having cam structures that define a travel path of the connector housing when installed.

BACKGROUND OF THE INVENTION

Generally connectors may be attached to panels or other structures to securely retain a connector in a desired position. Generally prior art housings are inserted perpendicularly relative to the body panel such that a connector within the housing and the housing itself would occupy the space behind the body panel along the perpendicular path during installation. There may be packaging requirements where the space behind the body panel that is perpendicular to the body panel is occupied by other structures or otherwise blocks the insertion path of the connector and connector housing. In such a situation it is desirable to have the connector housing pivot the connector behind the body panel at an angle during installation and then connect flush or perpendicular to the housing or panel such that the face of the housing is flush with the body panel.

There is therefore a need in the art for a connector housing that allows for defining a travel path of the connector housing when installed other than along a perpendicular insertion path. There is also a need in the art for a connector assembly and connector housing that travels along a desired travel path to ensure that connections to a body panel are performed in a desired order such that the connector housing may be securely flush mounted to the body panel.

SUMMARY OF THE INVENTION

In one aspect, there is disclosed a connector assembly that includes at least one connector having terminals. A connector housing having a cavity formed therein receives the at least one connector. The connector housing includes a body having opposing top and bottom walls joined with opposing side walls. The cavity extends through the front and rear walls. The top wall includes a plurality of cam ribs formed thereon that define a travel path of the connector housing when installed.

In another aspect, there is disclosed a connector assembly that includes at least one connector having terminals. A connector housing having a cavity formed therein receives the at least one connector. The connector housing includes a body having opposing top and bottom walls joined with opposing side walls. The side walls extend at an angle relative to a front flange and define a position of the cavity. The cavity extends through the front and rear walls. The top wall includes a plurality of cam ribs formed thereon that define a travel path of the connector housing when installed. The front flange is flush to a mounting panel in a final installed position.

In a further aspect, there is disclosed a connector assembly that includes a mounting panel having a hole formed therein. At least one connector including terminals is provided. The connector housing having a cavity formed therein receives the connector. The connector housing includes a body having opposing top and bottom walls joined with opposing side walls. The cavity extends through the front and rear walls. The top wall includes a plurality of cam ribs formed thereon. The cam ribs contact an edge of the hole during installation of the connector housing and define a travel path for the connector housing when installed.

DETAILED DESCRIPTION OF THE PREFERRED EMBODIMENTS

Figure 1:
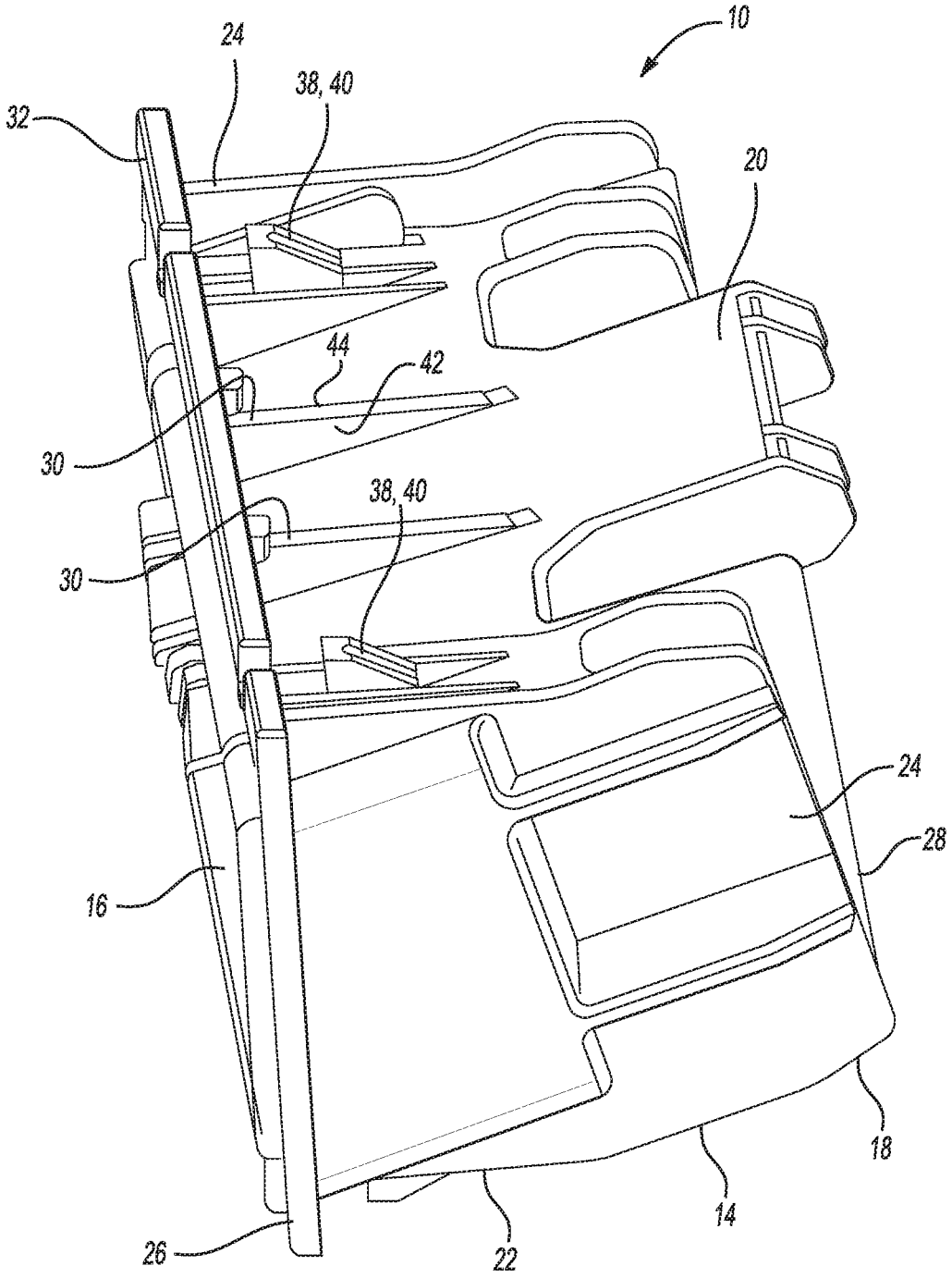
FIG. 1 is a perspective view of a connector housing.

Referring to the figures, there is shown a connector assembly 10 that includes at least one connector 12 having terminals. A connector housing 14 having a cavity 16 formed therein receives the at least one connector 12. The connector housing 14 includes a body 18 having opposing top and bottom walls 20, 22 joined with opposing side walls 24. The cavity 16 extends through the front and rear walls 26, 28. The top wall 20 includes a plurality of cam ribs 30 formed thereon. The cam ribs 30 define a travel path of the connector housing 14 when installed.

In one aspect, the connector housing 14 front wall 26 includes a flange 32 formed thereon that mate with a surface 34 of a mounting panel 36, as best shown in FIGS. 3-6. The top and bottom walls 20, 22 of the connector housing include connection structures 38 formed thereon that connect the connector housing 14 to the mounting panel 36 when in a final installed position. In one aspect, the connection structures 38 include raised tabs 40 formed on the top and bottom walls 20, 22 that are spaced from the flange 32 formed on the front wall 26. In this manner, the thickness of the body or mounting panel 36 may be received between the space between the flange 32 and tab 40.

In one aspect, during installation the cam ribs 30 define a travel path such that the raised tabs 40 formed on the bottom wall 22 connect with the mounting panel 36 prior to connection of the raised tabs 40 formed on the top wall 20 with the mounting panel 36. In this manner, a secure connection of the connector housing 14 and mounting panel 36 occurs as the connector housing 14 pivots along the travel path, as will be discussed in more detail below.

Figure 2:
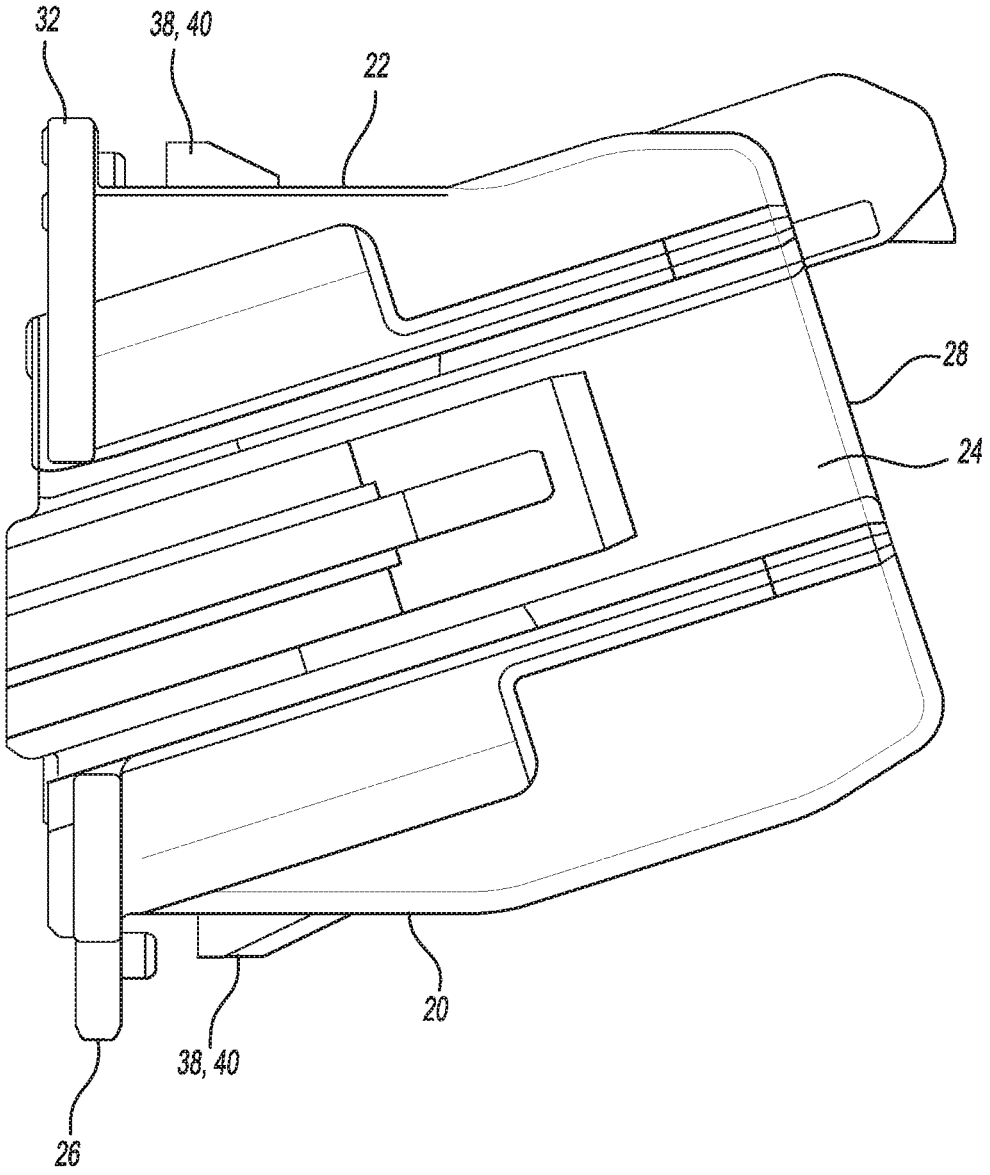
FIG. 2 is a side view of a connector housing.

Referring to FIG. 2, the side walls 24 extend at an angle relative to the front flange 32 and define an angular position of the cavity 16. In this manner, the cavity 16 may have an angled contour such that the connector 12 may be positioned at an angle into the connector housing 14.

Referring to FIG. 1, each of the plurality of cam ribs 30 extend from the top wall 20 and include an angled wall 42 that tapers as the cam rib 30 extends toward the rear wall 28 of the connector housing 14. Additionally, each of the plurality of cam ribs 30 includes a contact surface 44 that engages an edge 46 of an opening 48 in a mounting panel 36 as the connector housing is installed into the mounting panel 36, as will be discussed in more detail below.

Figure 3:
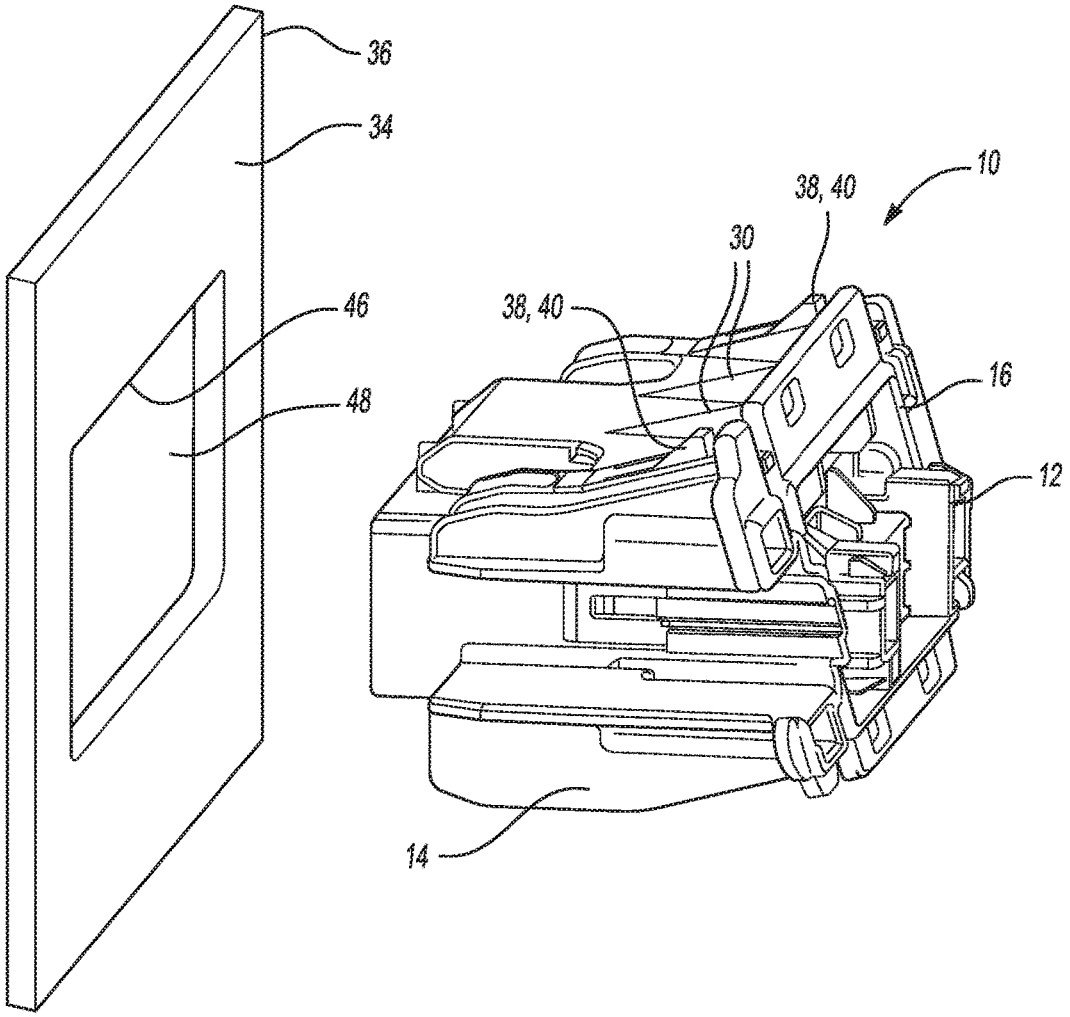
FIG. 3 is a partial perspective view of a panel and connector housing at a start of installation.

Referring to FIGS. 3-6, installation of the connector assembly 10 will be described. The at least one connector 12 is positioned and received within the cavity 16 of the connector housing 14. It should be realized that a corresponding connection or connector may be connected or joined with the connector 12 received in the connector housing 14 on a back side of the body panel 36. As shown in FIG. 3, the connector housing 14 including the connector 12 is initially positioned to be inserted within the hole or opening 48 formed in the body panel 36.

Figure 4:
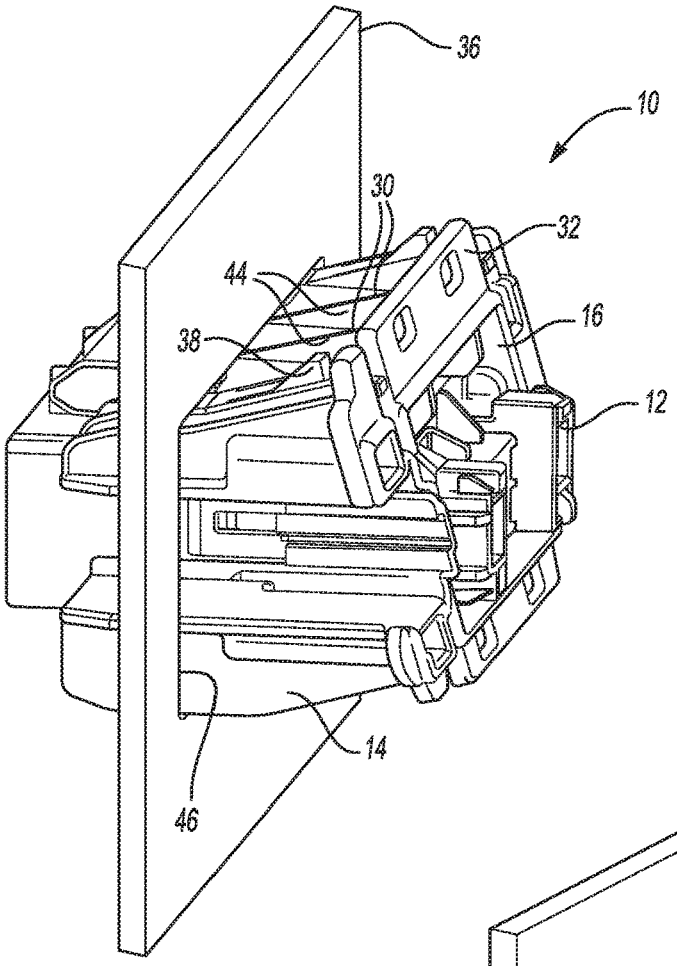
FIG. 4 is a partial perspective view of a body panel and connector housing with the connector housing partially inserted into the body panel.

Referring to FIG. 4, as the connector housing 14 is inserted into the hole 48 formed in the body panel 36, the contact surfaces 44 of the plurality of ribs 30 contact the edge 46 of the hole 48 to define a travel path of the connector housing 14 when it is installed. The angled or tapering ramp of the cam ribs 30 causes the connector housing 14 to pivot as it is being installed such that the connection structures 38 formed on the bottom wall 22 of the connector housing 14 couple with the body panel 36 prior to the connection structures 38 formed on the top wall 20. In this manner, the connector housing 14 pivots as it is being installed to avoid potential obstructions that may be along a perpendicular path of the connector housing 14 relative to the body panel 36.

Figure 5:
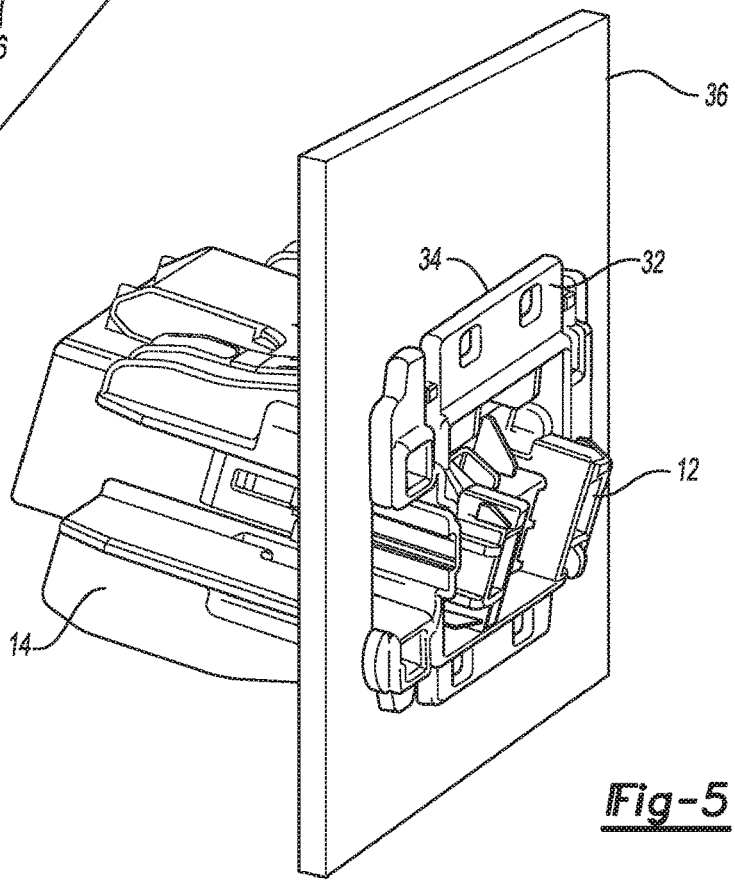
FIG. 5 is a partial perspective view of the body panel and connector housing in the final installed position.
Figure 6:
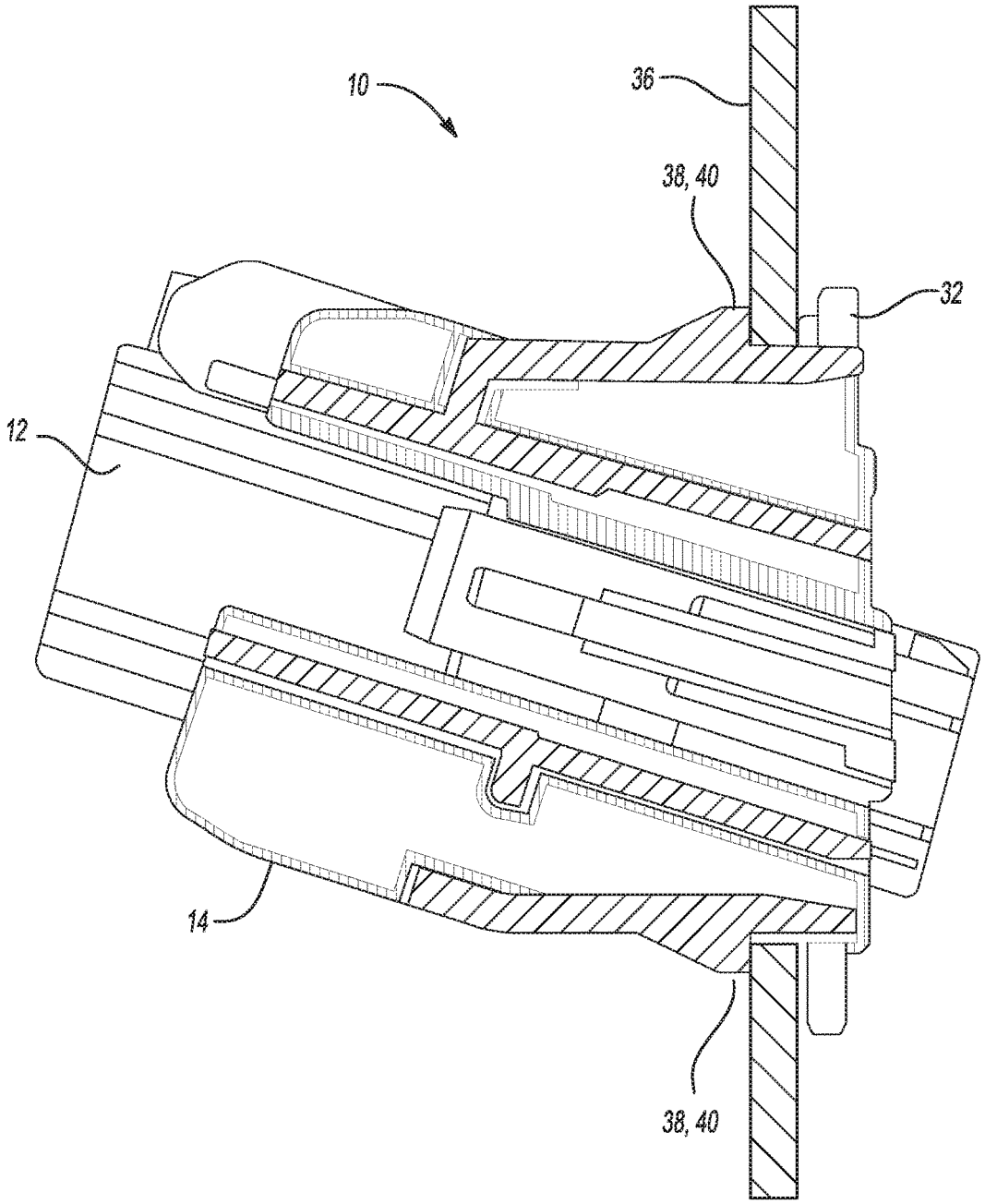
FIG. 6 is a partial side sectional view of the connector housing, connector, and body panel in the final installed position.

The connector housing 14 continues to be inserted and travel along the pivotal path until it reaches a final installed position, as shown in FIG. 5. In the installed position, the top and bottom connection structures 38 securely retain the connector housing 14 relative to the body panel 36. The flange 32 formed on the connector housing 12 is flush with a surface of the mounting panel 36. As best shown in FIG. 6, the body panel 36 is received between the raised tabs 40 and the front flange 32 to securely position the connector housing 14 within the hole 48 formed in the body panel 36. Additionally, the connector 12 is disposed within the cavity 16 formed in the connector housing 14 such that it can be mated with a corresponding connector on a back side of the body panel.

I claim:

1. A connector assembly comprising:

at least one connector including terminals;

a connector housing having a cavity formed therein, the cavity receiving the at least one connector, the connector housing including a body having opposing top and bottom walls joined with opposing side walls, the opposing side walls having a bottom edge and a top edge, wherein a top edge of the side walls includes a planar portion extending from the front wall and an angled portion extending from the planar portion to the rear wall, and wherein the bottom edge of the side walls includes a planar portion extending orthogonal from the front wall and an angled portion extending from the planar portion to the rear wall, wherein the angled portion of the bottom edge of the side walls is longer than the angled portion of the top edge of the side walls the cavity extending through the front and rear walls wherein the top wall includes a plurality of cam ribs formed thereon, the cam ribs and the planar portion and angled portion of the top and bottom edge of the side walls defining a travel path of the connector housing when installed.

2. The connector assembly of claim 1 wherein the front wall includes a flange formed thereon that mate with a surface of a mounting panel.

3. The connector assembly of claim 1 wherein the top and bottom wall includes connection structures formed thereon connecting the connector housing to a mounting panel.

4. The connector assembly of claim 3 wherein the connection structures include raised tabs formed on the top and bottom walls and spaced from a flange formed on the front wall.

5. The connector assembly of claim 4 wherein during installation the cam ribs define a travel path wherein the raised tabs formed on the bottom wall connect with the mounting panel prior to connection of the raised tabs formed on the top wall with the mounting panel.

6. The connector assembly of claim 1 wherein each of the plurality of cam ribs extend from the top wall and include an angled wall tapering as the cam rib extends toward the rear wall.

7. The connector assembly of claim 1 wherein each of the plurality of cam ribs includes a contact surface that engages an edge of an opening in a mounting panel as the connector housing is installed into the mounting panel.

8. A connector assembly comprising:

at least one connector including terminals;

a connector housing having a cavity formed therein, the cavity receiving the at least one connector, the connector housing including a body having opposing top and bottom walls joined with opposing side walls, a front flange, the opposing side walls having a bottom edge and a top edge, wherein a top edge of the side walls includes a planar portion extending from the front flange and an angled portion extending from the planar portion to the rear wall, and wherein the bottom edge of the side walls includes a planar portion extending orthogonal from the front flange and an angled portion extending from the planar portion to the rear wall, wherein the angled portion of the bottom edge of the side walls is longer than the angled portion of the top edge of the side walls, the cavity extending through the front and rear walls wherein the top wall includes a plurality of cam ribs formed thereon, the cam ribs and the planar portion and angled portion of the top and bottom edge of the side walls defining a travel path of the connector housing when installed wherein the front flange is flush to a mounting panel in a final installed position.

9. The connector assembly of claim 8 wherein the top and bottom wall includes connection structures formed thereon connecting the connector housing to a mounting panel.

10. The connector assembly of claim 9 wherein the connection structures include raised tabs formed on the top and bottom walls and spaced from a flange formed on the front wall.

11. The connector assembly of claim 10 wherein during installation the cam ribs define a travel path wherein the raised tabs formed on the bottom wall connect with the mounting panel prior to connection of the raised tabs formed on the top wall with the mounting panel.

12. The connector assembly of claim 8 wherein each of the plurality of cam ribs extend from the top wall and include an angled wall tapering as the cam rib extends toward the rear wall.

13. The connector assembly of claim 8 wherein each of the plurality of cam ribs includes a contact surface that engages an edge of an opening in a mounting panel as the connector housing is installed into the mounting panel.

14. A connector assembly comprising:

a mounting panel having a hole formed thereon;

at least one connector including terminals;

a connector housing having a cavity formed therein, the cavity receiving the connector, the connector housing including a body having opposing top and bottom walls joined with opposing side walls, the opposing side walls having a bottom edge and a top edge, wherein a top edge of the side walls includes a planar portion extending from the front flange and an angled portion extending from the planar portion to the rear wall, and wherein the bottom edge of the side walls includes a planar portion extending orthogonal from the front flange and an angled portion extending from the planar portion to the rear wall, wherein the angled portion of the bottom edge of the side walls is longer than the angled portion of the top edge of the side walls, the cavity extending through the front and rear walls wherein the top wall includes a plurality of cam ribs formed thereon, the cam ribs and the planar portion and angled portion of the top and bottom edge of the side walls contacting an edge of the hole during installation of the connector housing and defining a travel path of the connector housing when installed.

15. The connector assembly of claim 14 wherein the front wall includes a flange formed thereon that mate with a surface of the mounting panel.

16. The connector assembly of claim 14 wherein the top and bottom wall includes connection structures formed thereon connecting the connector housing to a mounting panel wherein the connection structures include raised tabs formed on the top and bottom walls and spaced from a flange formed on the front wall.

17. The connector assembly of claim 16 wherein during installation the cam ribs define a travel path wherein the raised tabs formed on the bottom wall connect with the mounting panel prior to connection of the raised tabs formed on the top wall with the mounting panel.

18. The connector assembly of claim 14 wherein the side walls extend at an angle relative to a front flange and define a position of the cavity.

19. The connector assembly of claim 14 wherein each of the plurality of cam ribs extend from the top wall and include an angled wall tapering as the cam rib extends toward the rear wall and wherein each of the plurality of cam ribs includes a contact surface that engages the edge of the opening in the mounting panel as the connector housing is installed into the mounting panel.

* * * * *